United States Patent [19]

Muir

[11] Patent Number: 4,478,412

[45] Date of Patent: Oct. 23, 1984

[54] EXERCISE DEVICE AND CONTROL VALVE THEREFOR

[76] Inventor: Arthur M. Muir, 207 Van Doren Dr., Natrona Heights, Pa. 15065

[21] Appl. No.: 382,136

[22] Filed: May 26, 1982

[51] Int. Cl.[3] ..... A63B 21/00; F16K 5/10

[52] U.S. Cl. ..... 272/130; 137/614.17; 251/209

[58] Field of Search ..... 137/614.17, 599, 881, 137/887; 272/130, 129, 134; 251/205, 206, 207, 309-311, 208, 209

[56] References Cited

U.S. PATENT DOCUMENTS

| | | | |
|---|---|---|---|
| 915,543 | 3/1909 | Billiard | 137/614.17 |
| 1,616,335 | 2/1927 | Rochefort | 137/614.17 |
| 2,095,560 | 10/1937 | Vickers | 137/599 |
| 2,391,126 | 12/1945 | Carter | 137/614.17 |
| 2,538,215 | 1/1951 | Stack | 137/887 |
| 3,037,354 | 6/1962 | Tennis | 137/881 |
| 3,165,117 | 1/1965 | Finelt | 137/614.17 |
| 3,912,265 | 10/1975 | Muir | 137/504 |
| 4,037,623 | 7/1977 | Beswick | 137/599 |
| 4,235,437 | 11/1980 | Ruis | 272/129 |
| 4,291,787 | 9/1981 | Brentham | 272/130 |

FOREIGN PATENT DOCUMENTS

| | | | |
|---|---|---|---|
| 769310 | 3/1957 | United Kingdom | 137/881 |

*Primary Examiner*—Richard J. Johnson

*Attorney, Agent, or Firm*—Webb, Burden, Robinson & Webb

[57] ABSTRACT

A control valve for use in a hydraulic system which includes a cylinder and a piston. The control valve has a casing with a cylindrical bore and a plurality of angularly spaced passages extending from the bore to the outside of the casing. A cylindrical rotor is rotatably mounted within the bore in the casing. The rotor has an upper chamber, a lower chamber, an orifice connecting the chambers and a plurality of angularly spaced ports to permit flow between the chambers and the passages in the casing. A check is located in one of the chambers in the rotor, and a mandrel is located in one of the chambers in the rotor to control flow through the orifice.

21 Claims, 18 Drawing Figures

EXERCISE DEVICE AND CONTROL VALVE THEREFOR

BACKGROUND OF THE INVENTION

1. Field of the Invention

This invention relates to a fluid control valve and particularly to a hydraulic fluid control valve and its use in an exercising device. The valve, exemplified by the enmbodiments described hereinafter, is a selectively reversible and adjustable control valve which permits variable resistances to be imparted to the movement of the exerciser in either of two directions, i.e. up and down.

2. Description of the Prior Art

Exercising devices for performing various exercises such as presses, curls, rowing, deadlift, pulldown and pullovers are well known in the art. They include various resistance devices including spring-loaded and hydrauilc shock absorbers, hydraulic valves and the like both one-way and reversible.

One form of exercising device and valve arrangement is disclosed in U.S. Pat. No. 3,912,265 which issued Oct. 14, 1975, the disclosure of which is incorporated herein by reference. That exercising device comprises a base arm and an operational arm joined through links to allow relative movement therebetween. A hydraulic cylinder divided into two chambers by a slidable piston carried by a piston rod is secured to the base arm with the piston rod extending through an end of the cylinder and affixed to the operational arm. An external flow line is provided between the two chambers of the cylinder so that fluid dispersed by movement of the piston can flow from one chamber to the other. A selectively reversible fluid flow control valve is placed in the line to regulate the direction of fluid flow in which substantial flow resisiance is encountered. The valve includes a variable sized orifice so that an increase in pressure creates an increased fluid flow to provide increased resistance to such flow.

A substantial advantage of a variable and reversible fluid flow valve in an exercising device is that the device is suitable for use by persons of differing physical capabilities. Thus, a stronger person must expend more energy to use the device than a person of lesser strength.

SUMMARY OF THE INVENTION

The present invention, exemplified in the embodiments described herein, is a novel reversible and adjustable fluid flow control valve especially suitable for use in an exercising device. The control valve is esseniially an adjustable and reversible valve having a check which permits flow in one direction and resists flow in the other direction and when used in an exercising device provides variable resistance to exercise movement.

In a first and preferred embodiment, the control valve includes a valve casing having inlet and outlet passages, a valve rotor within the casing having complementary passages, a check ball disposed in the valve rotor and an adjustable stem with a mandrel tapered on one side for controlling and directing fluid flow through the valve.

A second embodiment of the invention is a control valve having a mandrel with a tapered end on a stem for varying flow through the valve.

A third embodiment of the invention is a control valve in which the check is an elongated element having a rounded end to control flow through the valve.

A fourth embodiment of the invention is a control valve having a floating mandrel in the form of a valve plug for varying flow through the valve.

The valves are suitable for use in an exercising device, for example, of the type described in any above referenced patent.

DESCRIPTION OF THE PREFERRED EMBODIMENTS

Figure 1:
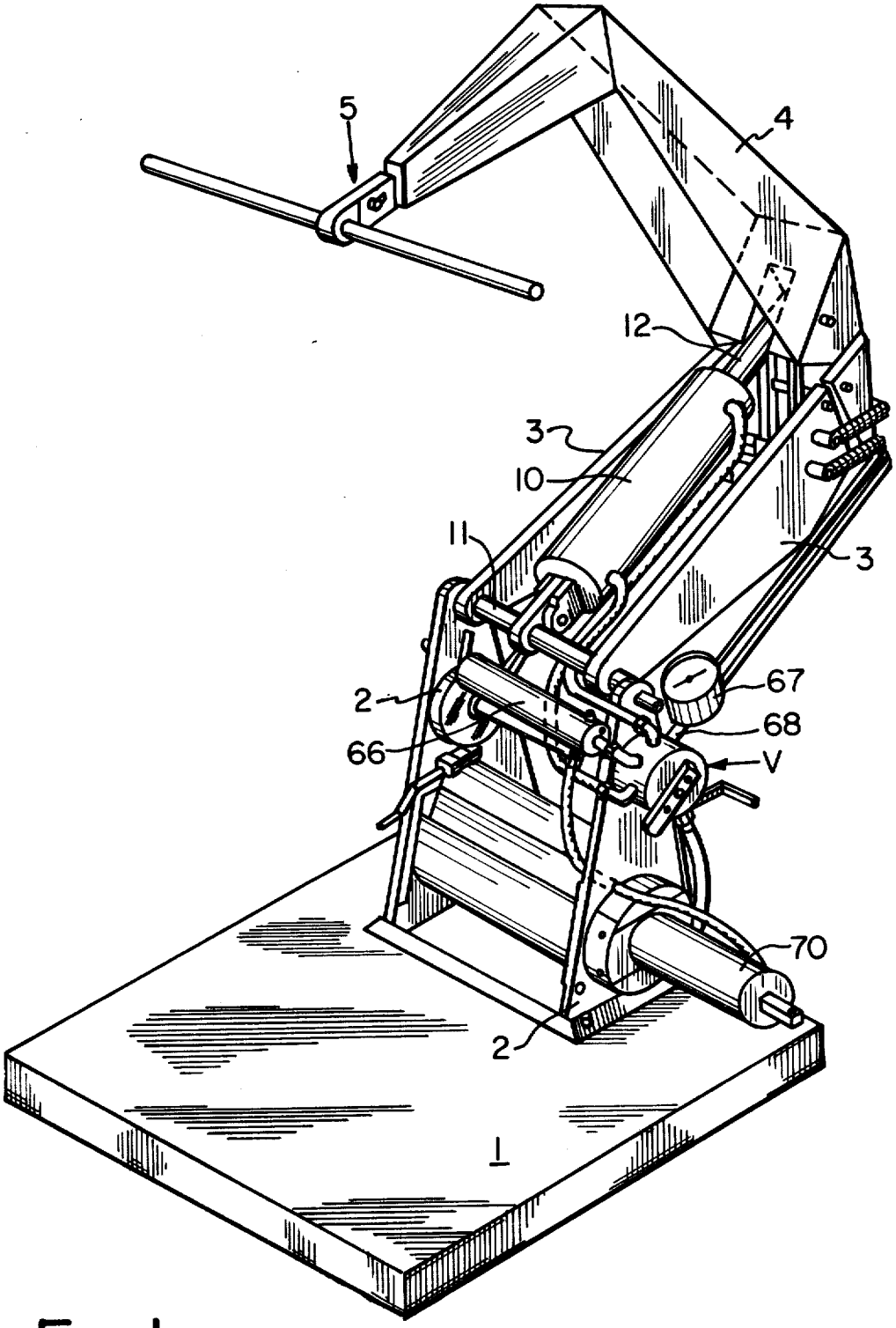
FIG. 1 is a perspective view of an exercising device incorporating a control valve in accordance with the invention.
Figure 2:
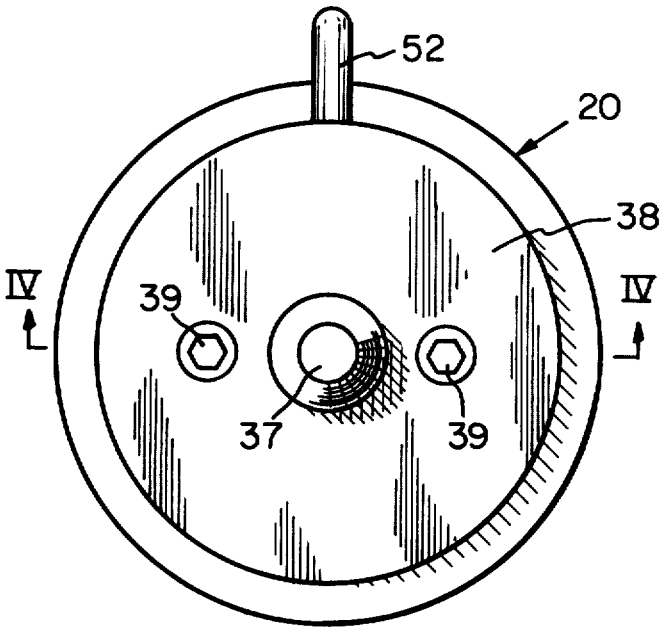
FIG. 2 is a plan view of an embodiment of the control valve.
Figure 3:
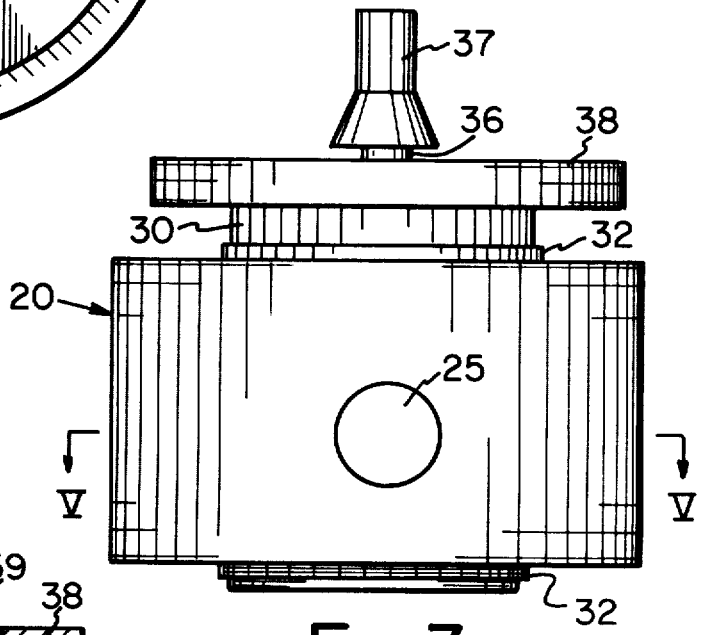
FIG. 3 is a side elevation view of the control valve of FIG. 2.

FIG. 1 shows a hydraulic exercising device having a base 1 with a pair of upstanding spaced brackets 2 secured thereto. Spaced arms 3 are mounted at the free end of brackets 2 and an operating arm 4 is attached to arms 3. A handle assembly 5 is located at the upper end of operating arm 4.

A hydraulic cylinder 10 is positioned between spaced arms 3 and is pivotally connected at one end to a rod 11 extending between the free ends of brackets 2. A piston rod 12 having a piston on the end within cylinder 10 extends from the other end of hydraulic cylinder 10 and has its free end connected to the lower end of operating arm 4 remote. from handle assembly 5. The hydraulic system of which the cylinder assembly is a part includes a selectively reversible and adjustable control valve V in accordance with an embodiment of the invention. While preferred embodiments of the control valve are described herein, it will be understood by those skilled in the art that they are only exemplary of valves which are suitable to control the flow of hydraulic fluid through an excercising device of the type described in U.S. Pat. No. 3,912,265.

A first preferred embodiment of valve V is shown in FIGS. 2–5 of the drawings. The valve has a cylindrical casing 20 having a plurality of threaded passages 21, 22, 23, 24 and 25 extending outwardly from a cylindrical central bore 26 through casing wall 27. A cylindrical valve rotor 30 fits closely within central bore 26 and is rotatable relative to casing 20. A plurality of spaced annular grooves 31 are provided on the exterior surface of rotor 30. A retaining ring 32 is secured in each of upper and lower grooves 31 to axially retain the rotor in valve casing 20. A resilient O-ring 33 is located in each intermediate groove 31 to seal the rotor when the rotor is in place in valve casing 20.

The external diameter of rotor 30 and the diameter of central bore 26 are dimensioned to provide only a slight clearance between the rotor and the casing to permit rotation of rotor 30 within central bore 26. The clearance is minimized in order to prevent leakage of hydraulic fluid from the passage on the pressurized side of the ball check to the passages on the unpressurized side of the ball check.

Control of hydraulic fluid flow through the valve is achieved by rotational adjustment of valve rotor 30 with respect of casing 20 through the use of a ball check 34 and through rotational adjustment of a mandrel 35 which is attached to a stem 36 and is adjustable by a knob 37 to restrict the flow of hydraulic fluid from an upper chamber 41 of the rotor. The upper end of rotor 30 is closed by a cover plate 38 which is held in place on the rotor by a plurality of screws 39, and stem 36 extends upwardly from mandrel 35 through a central hole in the cover plate. A radial port 40 extends from upper chamber 41 within rotor 30 to a cavity 42 having a substantially semicircular horizontal cross section which is formed by machining away a portion of the exterior of rotor 30. When the rotor is rotationally adjusted in casing 20, cavity 42 may be aligned with various pairs of the radial passages in casing 20 as is explained in detail hereinafter. A port 43 extends from cavity 42 to a lower chamber 44 which is located within rotor 30. Chambers 41 and 44 in rotor 30 are connected by an orifice O. The inner end of port 43 is machined to a slight bevel to form a seat 45 for ball check 34. Ball check 34, preferably of stainless steel, is normally biased by a coil spring 49 against seat 45 to prevent flow from lower chamber 44 through port 43 to cavity 42. In enlarged port 46 extends outwardly through rotor 30 from lower chamber 44 and is angularly spaced 180° from port 43. A pair of opposed ports 47 and 48 extend through the rotor from lower chamber 44, and each is angularly spaced 90° on an opposite side port 43.

Figure 4:
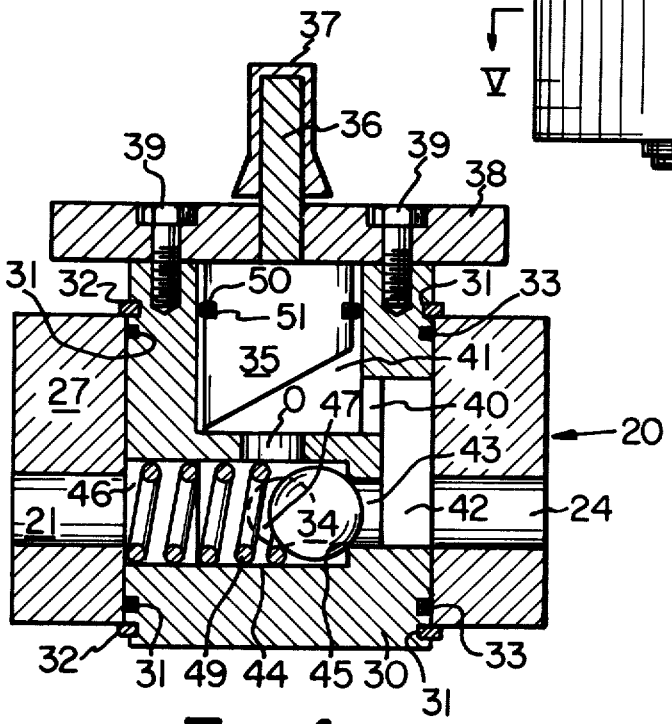
FIG. 4 is a section on line IV—IV of FIG. 2.

The resistance to fluid flow through control valve V is determined by rotation of knob 37 and stem 36 to rotate mandrel 35 in upper chamber 41 of rotor 30 to vary the amount of fluid which can flow through orifice O and port 40. The preferred mandrel, which is shown in FIG. 4, comprises a solid body in the form of a right circular cylinder having a tapered lower face extending at an angle of approximately 30° to the horizontal. The upper cylindrical portion of mandrel 35 fits closely within upper chamber 41, and an O-ring 50 is located in annular groove 51 in the mandrel to seal against loss of hydraulic fluid from the upper chamber. A handle 52 is secured to the upper end of rotor 30 to rotate the rotor within casing 20 to obtain the desired alignment of the ports in the rotor with the passages in the valve casing.

Figure 5:
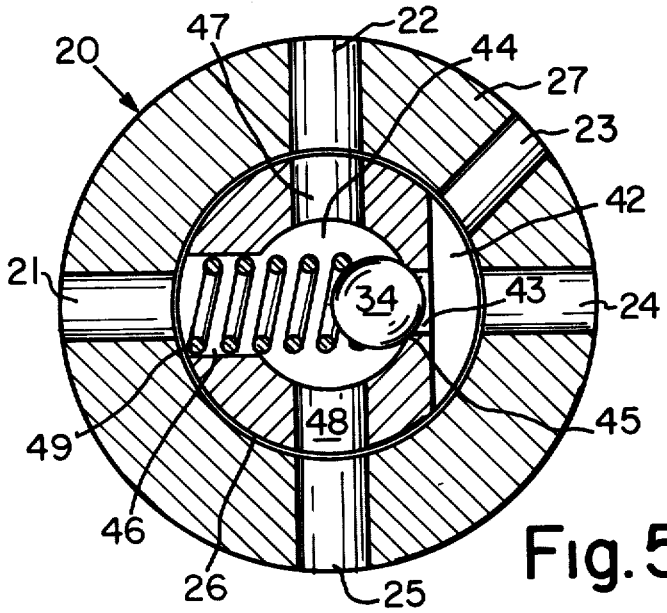
FIG. 5 is a section on line V—V of FIG. 3.

The operation of control valve V may be understood by referring particularly to FIGS. 4 and 5 of the drawings wherein rotor 30 contains radial ports 40, 43, 46, 47 and 48, and upper chamber lower chamber 44 are connected by orifice O. Ball check 34 is retained against seat 45 by coil spring 49 located in lower chamber 44 and in port 46. Pressurized hydraulic fluid flowing into the control valve passes through passage 22 and port 47 into lower chamber 44, and ball check 34 stops the fluid from entering port 43. The pressurized fluid will flow out of lower chamber 44 through port 48 and passage 25 and through port 46 and passage 21. The pressurized fluid will also flow out of lower chamber 44 through orifice O into upper chamber 41 and out of upper chamber 41 through port 40. The position of tapered mandrel 35 in upper chamber 41 will vary the net area of the opening of port 40 to determine the amount of fluid which can pass through port 40 in a given time at a given pressure. Fluid passing through port 40 enters cavity 2 from which it flows out of the control valve through passages 23 and 24.

When the direction of flow is reversed through the control valve, fluid flows into cavity 42 through passages 23 and 24 into port 43. The pressure of the fluid is suffcient to unseat ball check 34 from seat 45 and the fluid passes into lower chamber 44. From lower chamber 44 the fluid passes out of the valve through ports 46, 47 and 48 in the rotor and aligned passages 21, 22 and 25 in the casing. When the flow stops and the pressure is relieved, ball check 34 is seated on seat 45 by coil spring 49.

Figure 6:
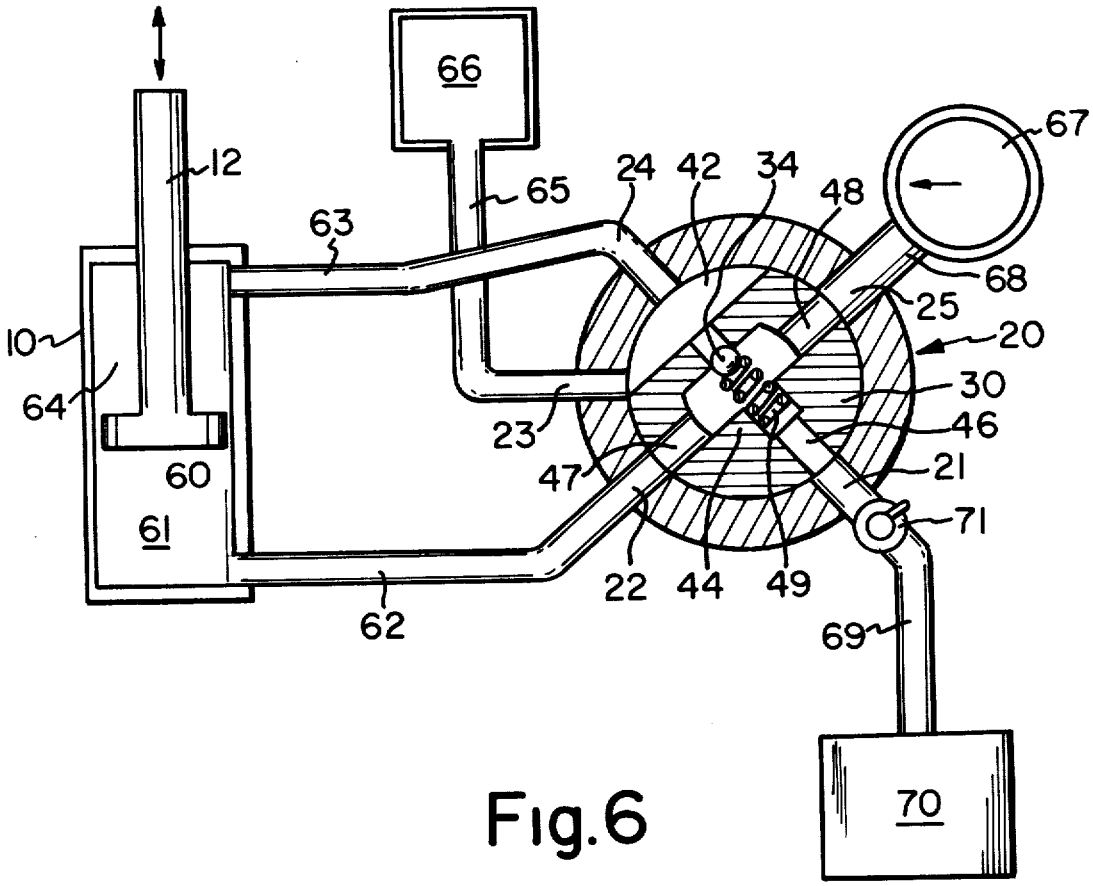
FIG. 6 is a schematic of a hydraulic system incorporating a control valve according to the invention in a first position.
Figure 7:
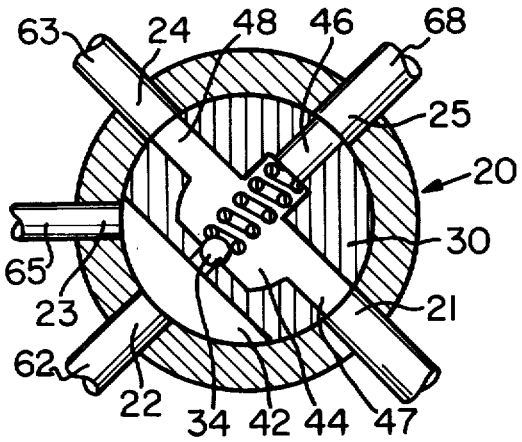
FIG. 7 is a partial schematic of the system shown in FIG. 6 showing the control valve in a second position.
Figure 8:
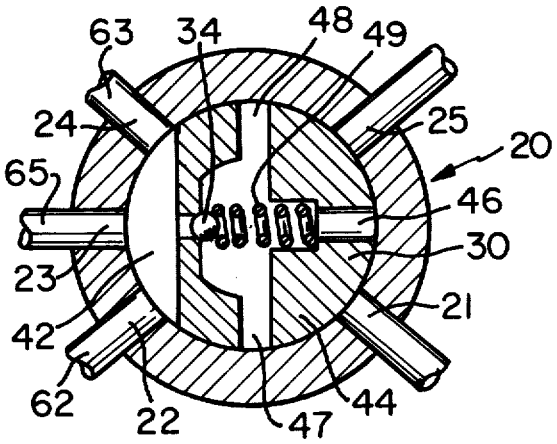
FIG. 8 is a partial schematic of the system shown in FIG. 6 showing the control valve in a third position.
Figure 9:
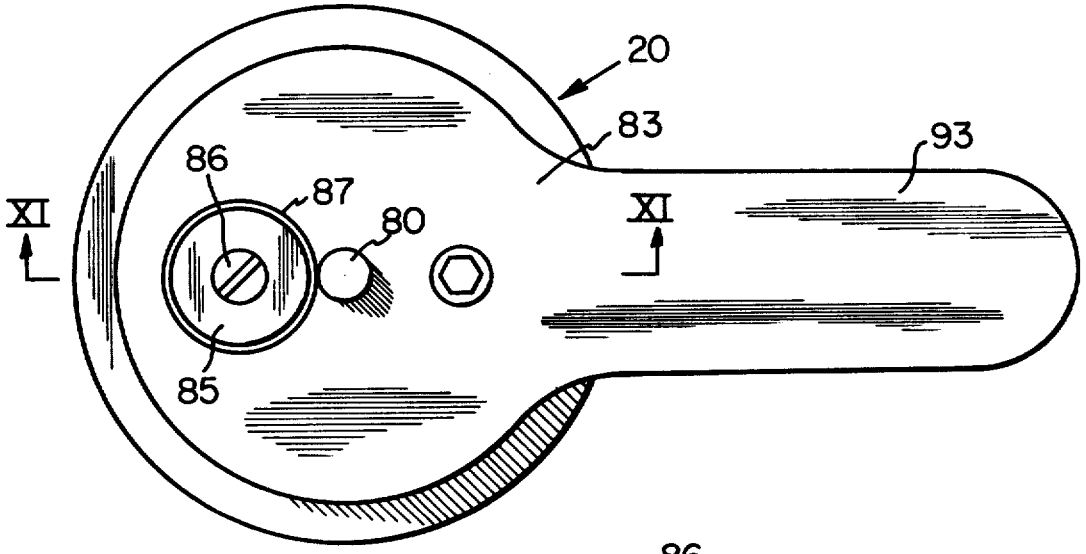
FIG. 9 is a plan view of a second embodiment of the control valve.
Figure 10:
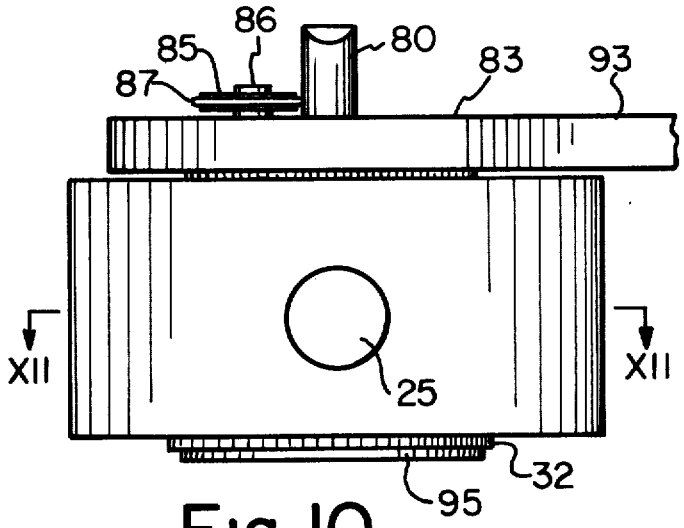
FIG. 10 is a side elevation view of the control valve of FIG. 9.
Figure 11:
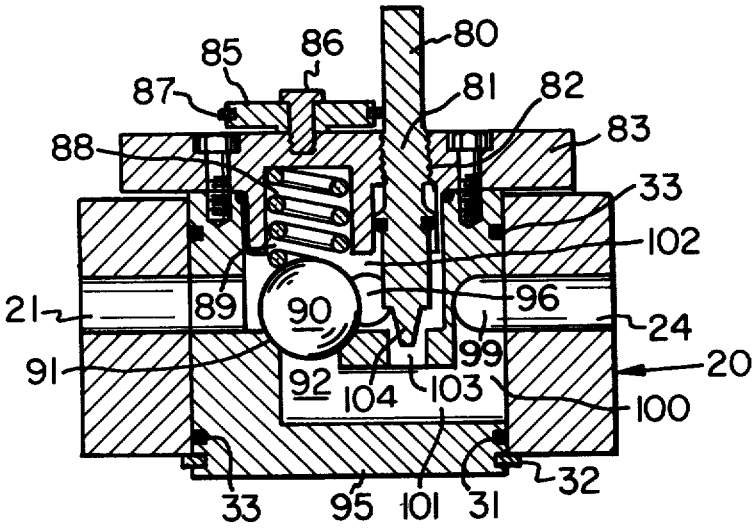
FIG. 11 is a section on line XI—XI of FIG. 9.
Figure 13:
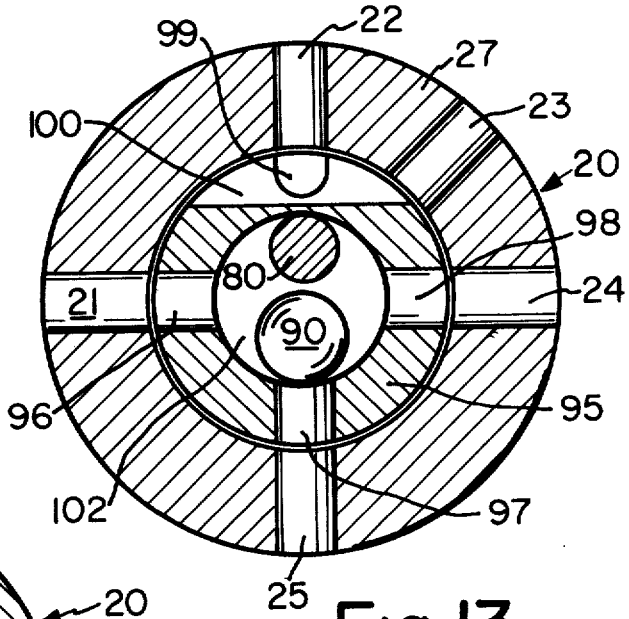
FIG. 13 is a section on line XII—XII of FIG. 10 showing the control valve in a second position.
Figure 12:
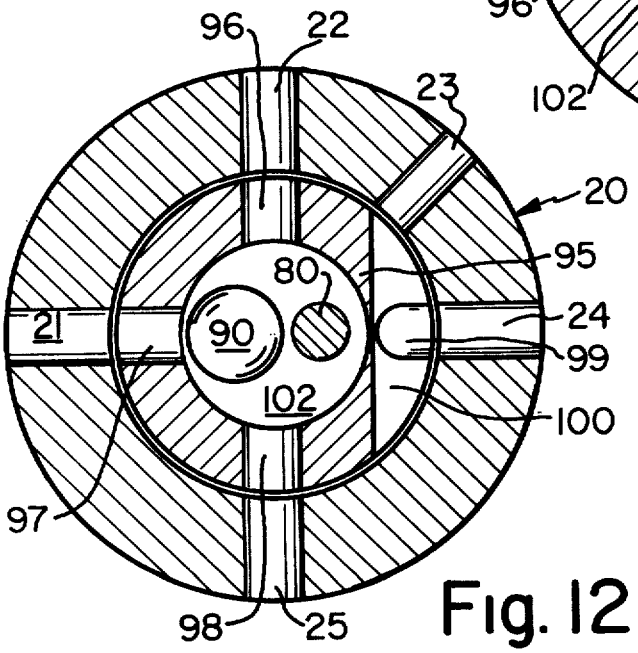
FIG. 12 is a section on line XII—XII of FIG. 10 showing the control valve in a first position.
Figure 14:
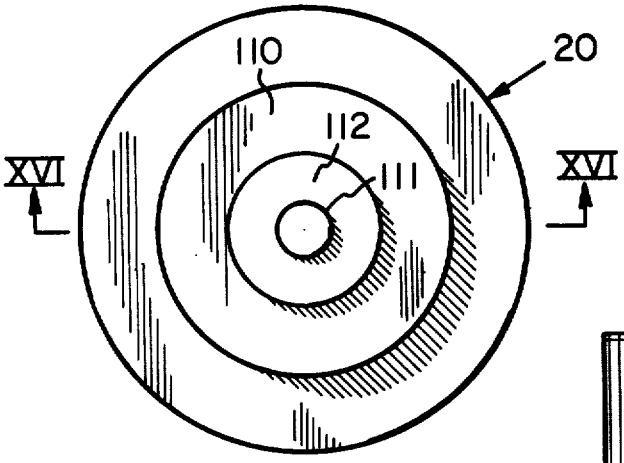
FIG. 14 is a plan view of a third embodiment of the control valve which may be used in a hydraulic system having a double rod cylinder and no reservoir.
Figure 15:
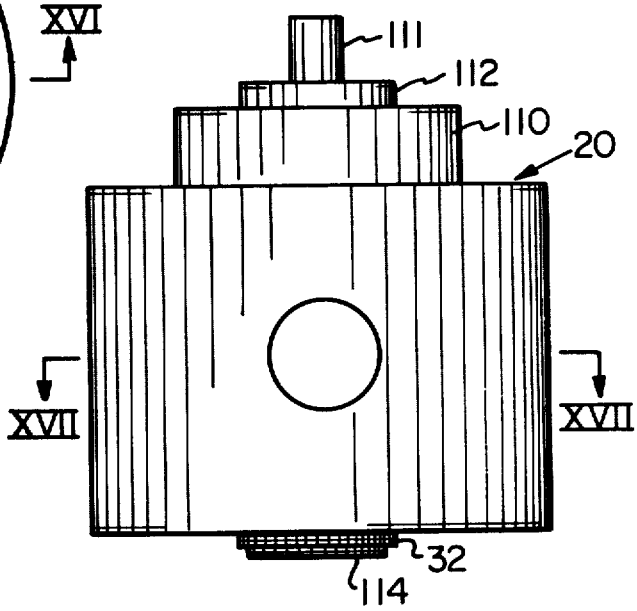
FIG. 15 is an elevation view of the control valve of FIG. 14.
Figure 16:
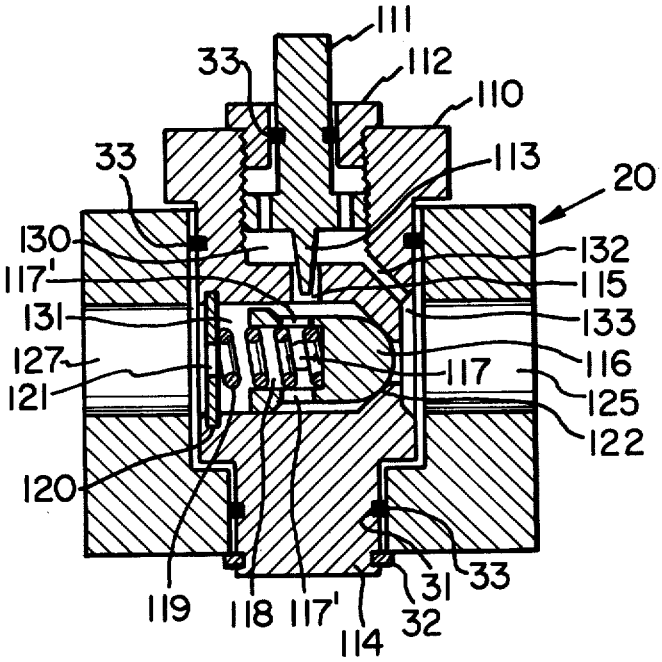
FIG. 16 is a section on line XVI—XVI of FIG. 14.

FIGS. 6–8 exemplify the operation of control valve V in a hydraulic system of an exercising device. The position of the rotor in the casing in FIG. 6 is the same as in FIGS. 4 and 5. The control valve will operate in the system in the following manner. When a downward force is applied to piston 60 in cylinder 10 by application of a lifting force to handle 5, fluid under pressure flows out of lower cylinder chamber 61 into conduit 62 and into lower chamber 44 of control valve V through passage 22 and port 47. In lower chamber 44 the fluid flow is stopped by the closed ball check 34 seated on seat 45 and fluid cannot pass into cavity 42 except through orifice O and port 40 which, according to the rotary adjustment of mandrel 35, is sufficiently open to permit some fluid to pass into cavify 42. The fluid then passes from cavity 42 into passage 24 and through conduit 63 into upper cylinder chamber 64. Due to the difference in displacement between cylinder chamber 64 and cylinder chamber 61 when piston 60 is raised, an excess volume of fluid is directed through the control valve to cylinder chamber 64, and when cylinder chamber 64 and conduit 63 are filled, the excess fluid passes from cavity 42 in the control valve through passage 23 and conduit 65 to reservoir 66.

It is pointed out that port 46 and passage 21 and port 48 and passage 25 are on the pressure side of closed ball check 34. A pressure gauge 67 is connected to passage 25 by conduit 68 so that the pressure created by the load on piston 60 when it is moved downwardly will appear on the pressure gauge. It is also pointed out that passage 21 is connected to a conduit 69 which is connected to a source of pressurized fluid 70. A shutoff valve 71 is located in conduit 69. In the present mode of operation, shutoff valve 71 is closed and, therefore, pressurized fluid from 70 cannot act upon fluid in the control valve and fluid cannot flow past valve 71 in conduit 69.

When the direction of movement of piston 60 is reversed to move in the upward direction with a smaller force on handle 5, fluid flows from upper cylinder chamber 64 through conduit 63 and passage 24 into cavity 42 in valve V. The fuild proceeds from cavity 42 through port 43 and has sufficient pressure to move ball check 34 away from seat 45 so that a larger volume of fluid under a lower pressure than the fluid originally flowing from lower cylinder chamber 61 through conduit 62 passes to control valve V. From lower chamber 44 the fluid flows through port 47 and passage way 22 into conduit 62 and into lower cylinder chamber 61. The smaller displacement of fluid from upper cylinder chamber 64 now requires supplemental fluid from reservoir 66 in order to fill lower cylinder chamber 61. This extra volume of fluid is supplied by conduit 65, passage 23, cavity 42, ball check 34, port 47, passage 22 and conduit 62.

With specific reference to FIG. 7, rotor 30 of the control valve has been rotated 90° to the position shown. The load on piston 60 is in the upward direction and fluid under pressure flows from upper cylinder chamber 64 through conduit 63 into passage 24 in the valve casing and into port 48 of the valve rotor from which it passes into lower chamber 44. In chamber 44 the fluid is stopped by ball check 34 from passing into cavity 42 except through orifice O and port 40 which are adjusted by mandrel 35 to the appropriate opening to permit the desired amount of fluid to pass through port 40. Fluid flows into cavity 42 and from cavity 42 flows into passage 22 in the valve casing. The fluid then passes through conduit 62 and into lower cylinder chamber 61. Again this volume of fluid from upper cylinder chamber 64 is supplemented by the necessary volume of fluid from reservoir 66 which flows through conduit 65 into passage 23 and then into cavity 42 and passage 22. It is again pointed out that shutoff valve 71 is closed and pressurizing device 70 is not connected into the system. The fluid in lower chamber 44 also passes through port 46 and passage 25 to conduit 68 and pressure gauge 67 which registers the pressure of the fluid flowing through the control valve.

With further reference to FIG. 7, when the direction of the force on piston 60 is reversed and the load on the piston is in the downward direction, the flow is from lower cylinder chamber 61 through conduit 62 into passage 22, cavity 42 and port 43. The pressure of the fluid is sufficient to open ball check 34 to permit a high volume of fluid to pass into lower chamber 44. The fluid flows from a lower chamber 44 through port 48, passage 24 and conduit 63 into upper cylinder chamber 64. The excess of the fluid from lower cylinder chamber 61 that cannot be accepted by upper cylinder chamber 64 passes through cavity 42, passage 23 and conduit 65 into reservoir 66.

With specific reference to FIG. 8, valve rotor 30 is rotated 45° from its position in FIG. 6 so that cavity 42 is aligned with passages 22, 23 and 24. The fluid flowing from cylinder chambers 61 and 64 and from reservoir 66 can pass freely to or from one another through cavity 42 without any restriction by the ball check 34 or by mandrel 35.

When it is necessary to pressurize the fluid in the hydraulic system by means of pressure device 70, control valve rotor 30 is rotated to the position shown in FIG. 6 of the drawings. Metering orifice O and port 40 are closed by rotating mandrel 35 180° from the position shown in FIG. 4 so that the mandrel blocks orifice O and port 40. Hence, cavity 42 and passages 23 and 24 are shut off by ball check 34 and mandrel 35. Manual shutoff valve 71 is opened to permit pressurized fluid to flow from pressure device 70 through conduit 69. The fuild passes through passage 21 and port 46 into lower chamber 44. The pressurized fluid travels from lower chamber 44 through port 47, passage 22 and conduit 62 into lower cylinder chamber 61 to move piston 60 in the upward direction. It is pointed out that the fluid in lower chamber 44 will also travel through port 48 and passage 25 into conduit 68 to pressure gauge 67.

If the pressurizing device is used when the valve rotor is in the position shown in FIG. 7, orifice O and port 40 are closed by mandrel 35 so that cavity 42 and passages 22 and 23 are shut off by ball check 34 and mandrel 35. Pressurized fluid flows from pressurizing device 70 through passage 21 and port 47 into lower chamber 44. From lower chamber 44 the fluid flows through port 48, passage 24 and conduit 63 into upper cylinder chamber 64 to move piston 60 in the downward direction. The pressurized fluid in lower chamber 44 will also pass through port 46, passage 25 and conduit 68 to pressure gauge 67.

It is pointed out that the flow from the unpressurized cylinder chamber in cylinder 10 in the immediately proceeding examples using pressurizing device 70 will pass to control valve V and then through cavity 42, passage 23 and conduit 65 to reservoir 66.

A second embodiment of a control valve according to the invention is shown in FIGS. 9–13, inclusive wherein the configurations of the valve stem and rotor have been modified. Like reference numerals are used in FIGS. 9–13 to identify like parts as in FIGS. 1–8. In this embodiment valve stem 80 is in the form of a cylindrical rod having a threaded portion 81 which engages internal threads 82 in an opening in cover plate 83 of the rotor. By rotating the valve stem, which has its lower end formed as a tapered mandrel or needle, the size of an orifice can be adjusted between fully open and fully closed modes. An indicator disc 85 is mounted on a shoulder screw 86 threaded into the top surface of rotor cover plate 83. The indicator disc carries an outer traction ring 87 of frictional material which engages the outer surface of valve stem 80 so that the indicator disc rotates when the valve stem is rotated to indicate the adjusted size of an orifice 103. A coil spring 88 is positioned vertically in a valve bore 89 to engage a ball check 90 and maintain it in the closed position against a seat 91 formed at the end of port 92. Cover plate 83 is attached to a valve rotor 95 by machine screws, and a handle 93 is fixed to cover plate 83 for rotation of the cover and the valve rotor attached thereto.

Valve rotor 95 in the embodiment of FIGS. 9–13 is formed with four radial ports 96, 97, 98 and 99 which are angularly spaced 90° so that they can be aligned with the passages in the valve casing. Port 96 is in communication with a cavity 100 having a horizonial cross section in the shape of a semicircle. The cavity communicates with a lower chamber 101 in rotor 95 which communicates with an upper chamber 102 in rotor 95 through orifice 103 and through port 92. The size of orifice 103 is adjustable by tapered mandrel or needle 104 on the lower end of valve stem 80.

Operationally, the valve in FIGS. 9–13 functions in the manner previously described in connection with the hydraulic system shown in FIGS. 6–8. It may be employed in place of the control valve illustrated in FIGS. 2–5 in any environment where a reversible and adjustable flow control valve is required.

A third embodiment of a control valve according to the invention is shown in FIGS. 14–17. inclusive, wherein like numerals designate like parts as in FIGS. 1–13. In this embodiment, the configuration of the rotor is modified to include an upper annular shoulder portion 110 having a threaded bore. A collar 112 is threaded in the bore of shoulder portion 110 of the rotor and a stem 111 is journaled within the collar and threadedly connected with the bore for vertical adjustment of a tapered mandrel or needle 113 within rotor 114 to adjust the size of orifice 115 and to control flow therethrough. An operating handle (not shown) is fixed to rotor 114 to rotate the rotor in cylindrical casing 2O.

Figure 17:
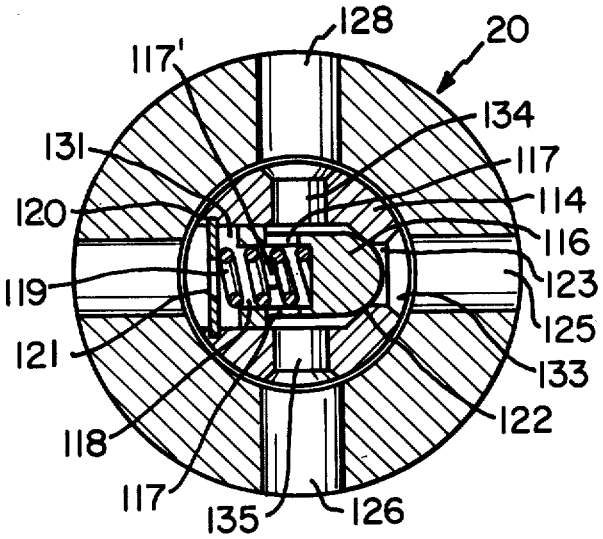
FIG. 17 is a section on line XVII—XVII of FIG. 15.

In this embodiment the check is in theform of an elongated element 116 having a bullet nose and having horizontal passages 117 extending therethrough at right angles to the axis of the element and vertical passages 117′ extending therethrough at right angles to the axis of the element. An axial bore 118 extends from the rear surface of element 116 to intersect radial passages 117 and 117′. A coil spring 119 is partially inserted into bore 118 with its outer end positioned against a retainer ring 120 which is held in rotor 114. The retainer ring has an axial opening 121 which is aligned with bore 118. A spring 119 normally biases the bullet nose of element 116 against seat 122 at the end of a port 123 in rotor 114 which communicates with a cavity 133 formed in the extertor surface of rotor 114, Rotor 114 is formed with an upper chamber 130 and a lower chamber 131 which is connected to the upper chamber by an orifice 115. A port 132 connects upper chamber 130 with a cavity 133. Radial ports 134 and 135 are formed in rotor 114 and are angularly spaced 180° from each other and 90° on opposite sides of cavity 133. In FIG. 17, the radial ports in rotor 114 are aligned with horizontal ports 117 in elongated element 116 and thereby commnunicate wiih axial bore 118 in element 116 and through the bore with lower chamber 131.

It will be noted that in this embodiment there are four radial passages through casing 20 which are designated 125, 126, 127 and 128 which are adapted to be connected with the hydraulic lines of an exercising device of the type shown using a double rod end cylinder. Since the exercising device uses a double rod end cylinder rather than a single rod cylinder, a reservoir is not required for the hydraulic fluid and, therefore, valve casing 20 does not have a fifth passage as required in the embodiments of FIGS. 2–8, FIGS. 9–13 and FIG. 18. While the valve casing in the embodiment of FIGS. 14–17 has only four passages 125, 126, 127 and 128, it will be understood by those skilled in the art that the casing could be formed with a fifth passage and a plug inserted in that passage when the valve is used in a system without a reservoir.

The operation of the valve of this embodiment is substantially similar to that of the previously described embodiments of the invention, except that flow is through the rotor in every rotational position of the rotor. When the rotor is in the position shown in FIGS. 16 and 17, ports 134 and 135 in rotor 114 allow flow from passages 126 or 128 to horizontal passages 117, axial bore 118 and lower chamber 131 and through vertical passages 117′ to orifice 115 and upper chamber 130. Thus, fluid may pass in and out of the valve casing through passages 126, 127 and 128 without being controlled by either check 116 or tapered mandrel 113. For example, if passage 127 is closed by a plug, pressurized fluid supplied through passage 126 will pass to a pressure gauge through passage 128 and to or from passage 125 under the control of check 116 and tapered mandrel 113 in orifice 115.

Figure 18:
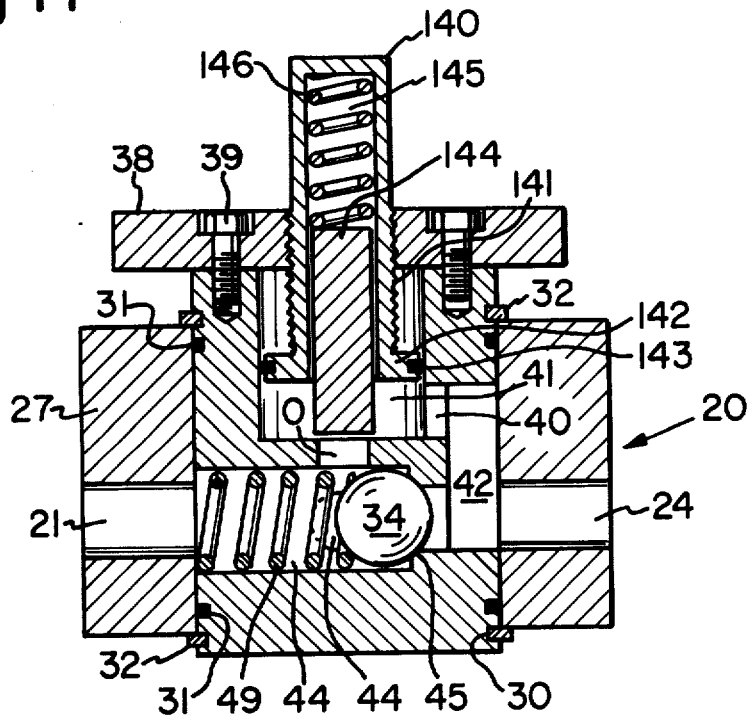
FIG. 18 is a section through a fourth embodiment of the control valve.

A fourth embodiment of a rotary control valve according to the invention is shown in FIG. 18 which is a vertical section through the control valve and wherein like reference numerals are used to identify like parts as in FIGS. 1–17. The embodiment shown in FIG. 18 is similar to the embodiment shown in FIGS. 2–4 except that a floating valve plug or mandrel is used to control the flow through orifice O. A hollow rotary stem 140 is threaded in cover 38 by threads 141 so that it can move relative to cover 38 and to valve rotor 30. An annular shoulder 142 is located at the lower end of the rotary stem within upper chamber 41 in valve rotor 30, and an O-ring 143 is located on the periphery of the shoulder to provide a seal between the periphery of the shoulder and the surface of upper chamber 41 in valve rotor 30. A slidable valve plug or mandrel 144 is partially located in the lower portion of an elongated chamaber 145 formed by the hollow rotary stem. the lower end of the valve plug overlies and is coaxial with orifice O between upper chamber 41 and lower chamber 44. A coil spring 146 is located between the upper end of slidable valve plug 144 and the closed top of chamber 145 in rotary stem 140.

The rotary valve shown in FIG. 18 operates in the same manner as previously described for the rotary valve shown in FIGS. 4 and 5. Fluid under pressure flows from a cylinder chamber into lower chamber 44 and through orifice O into upper chamber 41. Fluid flowing through orifice O will force valve plug 144 upwardly against the force of spring 146 to compress the spring against the top of chamber 145 in rotary stem 140. When the rotary stem is adjusted upwardly by threads 141, it will decrease the compression on spring 146 thereby requiring less fluid pressure on the bottom end of valve plug 144 to raise the valve plug against the force of the spring to permit fluid to flow through orifice O. Alternatively, when the rotary stem is adjusted downwardly into the bottom position as shown in FIG. 18, the downward force applied to valve plug 144 is increased because spring 146 is compressed. Therefore, when it is desired to decrease the downward force on valve plug 144 and thereby decrease the amount of fluid pressure required to raise the valve plug, rotary stem 140 is adjusted upwardly.

The valve shown in FIG. 18 provides a relatively fine degree of control of the pressurized fluid flowing through orifice O to the non-pressurized chamber of cylinder 10 through port 40 and passage 24 when the valve is in the position shown in FIG. 6 of the drawings.

While the control valve according to the invention has been described with reference to an exercising device, it will be understood by those skilled in the art that the valve may be employed in any device wherein a reversible and adjustable valve is required. The control valve may be made of metal, e.g. stainless steel, brass, etc. or any other suitable material.

Having described presently preferred embodiments of the invention, it is to be understood that it may be otherwise embodied within the scope of the appended claims.

I claim:

1. An excercising device having a base, spaced brackets connected to and extending upwardly from said base; spaced arms connected at one end to the upper ends of said brackets; an operating arm pivotally connected to the other ends of said spaced arms; a handle connected to said operating arm; a hydraulic system including a cylinder connected to the upper ends of said brackets and said one end of said spaced arms, a piston within said cylinder, a piston rod connected between said piston and said operating arm; and a control valve forming a part of said hydraulic system, said control valve having:

A. a casing with a cylindrical bore and a plurality of passages extending from said bore to the outside of said casing, said passages connected into said hydraulic system;

B. a cylindrical valve rotor located within said cylindrical bore of said casing and having
(a) an upper chamber,
(b) a lower chamber,
(c) an orifice connecting said upper chamber with said lower chamber,
(d) means in said upper chamber to vary the amount of flow through said upper chamber,
(e) a plurality of ports formed in said rotor to permit flow between said chambers and at least one of said plurality of passages in said casing,
(f) a check in one of said chambers of said rotor, and
(g) means biasing said check in a closed position to prevent flow through one of said plurality of ports formed in said rotor in one direction and to permit flow through said port in the opposite direction; and C. means for rotating said rotor relative to said casing to selectively align ports in said rotor with passages in said casing to permit flow in said hydraulic system through said control valve.

2. An exercising device as set forth in claim 1 wherein said means to vary the amount of flow through said upper chamber adjusts the effective size of said orifice to control the amount of flow through said orifice and thereby vary the resistance required to move said piston rod by said operating arm, whereby an operator of the exercising device experiences varying degrees of resistance to movement of said operating arm during operation of the exercising device as determined by the size of said orifice.

3. An exercising device as set forth in claim 1 wherein said means in said upper chamber is a tapered mandrel and means supporting said tapered mandrel for movement relative to said orifice between said chambers, whereby movement of said tapered mandrel varies the effective size of said orifice to control the flow through said orifice.

4. An exercising device as set forth in claim 1 wherein said means in said upper chamber is a mandrel and means for rotating said mandrel relative to said rotor.

5. An exercising device as set forth in claim 3 wherein said means in said upper chamber is a mandrel, said mandrel having the shape of a righi cylinder with an angular face at one end and means for rotating said mandrel relative to said rotor.

6. An exercising device as set forth in claim 3 wherein said means in said upper chamber is a needle and means supporting said needle for movement relative to said orifice between said upper chamber and said lower chamber, whereby movement of said needle varies the effective size of said orifice to control the flow through said orifice.

7. An excercising device as set forth in claim 3 wherein said means in said upper chamber is a valve plug having a lower end overlying said orifice, means acting on the upper end of said valve plug to force said valve plug toward said orifice and means to change the force on said valve plug, whereby the pressure of the fluid passing through said orifice required to move said valve plug is controlled by said means acting on the upper end of said valve plug and said means to change the force on said valve plug.

8. An exercising device as set forth in claim 1 or 2 including a fluid reservoir in said hydraulic system in communication with said control valve and with said cylinder to accommodate different loadings of said piston in said cylinder.

9. An exercising device as set forth in claim 1 or 2 including a pressure gauge in said hydraulic system in communication with said control valve and with said cylinder to indicate the pressure applied to said piston in said cylinder upon movement of said piston.

10. An exercising device as set forth in claim 1 or 2 including a source of pressurized fluid in said hydraulic system in communicatton with said control valve and a shutoff valve in said hydraulic system located between said source of pressurized fluid and said control valve.

11. A control valve comprising:

A. a casing having a cylindrical bore and a plurality of passages extending from said bore to the outside of said casing adapted to be connected into a hydraulic system;

B. a cylindrical valve rotor located within said cylindrical bore of said casing and having
(a) an upper chamber,
(b) a lower chamber,
(c) an orifice connecting said upper chamber with said lower chamber,
(d) means in said upper chamber to vary the amount of flow through said upper chamber,
(e) a plurality of ports formed in said rotor to permit flow between said chambers and at least one of said plurality of passages in said casing,
(f) a check in one of said chambers of said rotor, and
(g) means biasing said check in a closed position to prevent flow through one of said plurality of ports formed in said rotor in one direction and to permit flow through said port in the opposite direction, and C. means for rotating said rotor relative to said casing to selectively align ports in said rotor with passages in said casing to permit flow through said control valve.

12. A control valve as set forth in claim 11 wherein said casing is a right circular cylinder having
(a) four passages angularly spaced 90° from one another, each of said passages having one end opening into said cylindrical bore and an opposite end opening to the outer surface of said casing; and
(b) a fifth passageway located between two of said angularly spaced passages extending from said cylindrical bore to the outer surface of said casing; and said rotor including a cavity formed at the outer surface thereof having a substantially semicircular cross section and communicating with at least one of said plurality of ports in said rotor, said cavity also communicating with at least two of said passages in said casing upon selective rotational adjustment of said rotor in said casing to permit flow into and out of the control valve through said passages without passing through said rotor.

13. A control valve as set forth in claim 11 wherein said check is a ball.

14. A control valve as set forth in claim 13 wherein said ball is located in said lower chamber of said rotor.

15. A control valve as set forth in claim 13 wherein said ball is located in said upper chamber of said rotor.

16. A control valve as set forth in claim 11 wherein said check is an elongated cylindrical element having a bullet-shaped nose.

17. A control valve as set forth in claim 16 wherein said elongated cylindrical element is located in said lower chamber of said rotor.

18. A control valve as set forth in claim 11 wherein said means in said upper chamber to vary the amount of flow through said upper chamber is an elongated stem extending into said upper chamber, a mandrel at the end of said stem in said upper chamber and means to move said mandrel relative to said orifice to vary the effect size of said orifice to control the amount of flow through said orifice.

19. A control valve as set forth in claim 11 wherein said means in said upper chamber to vary the amount of flow through said upper chamber is a cylindrical mandrel having an angular face at its lower end and means on the upper end of said mandrel to rotate said mandrel in said upper chamber relative to said rotor.

20. A control valve as set forth in claim 11 wherein said means in said upper chamber is a needle and means supporting said needle for movement relative to said orifice between said upper chamber and said lower chamber, whereby movement of said needle varies the effective size of said orifice to control the flow through said orifice.

21. A control valve as set forth in claim 11 wherein said means in said upper chamber is a valve plug having a lower end overlying said orifice, means acting on the upper end of said valve plug to force said valve plug toward said orifice and means to change the force on said valve plug, whereby the pressure of the fluid passing through said orifice required to move said valve plug is controlled by said means acting on the upper end of said valve plug and said means to change the force on said valve plug.

* * * * *

UNITED STATES PATENT AND TRADEMARK OFFICE

CERTIFICATE OF CORRECTION

PATENT NO. : 4,478,412

DATED : October 23, 1984

INVENTOR(S) : Arthur M. Muir

It is certified that error appears in the above-identified patent and that said Letters Patent is hereby corrected as shown below:

Column 1 Lines 20 & 21 "hydrauilc" should read --hydraulic--.

Column 1 Line 38 "resisiance" should read --resistance--.

Column 1 Line 53 "esseniially" should read --essentially--.

Column 2 Line 8 "any" should read --my--.

Column 2 Line 63 After "remote" delete --.--.

Column 3 Line 23 "passage" should read --passages--.

Column 3 Line 50 "In" should read --An--.

Column 3 Line 55 After "side" insert --of--.

Column 4 Line 6 Before "lower" insert --41 and--.

Column 4 Line 22 "cavity 2" should read --cavity 42--.

Column 4 Line 27 "suffcient" should read --sufficient--.

Column 4 Line 49 "cavify" should read --cavity--.

UNITED STATES PATENT AND TRADEMARK OFFICE

CERTIFICATE OF CORRECTION

PATENT NO. : 4,478,412

DATED : October 23, 1984

INVENTOR(S) : Arthur M. Muir

It is certified that error appears in the above-identified patent and that said Letters Patent is hereby corrected as shown below:

Column 5 Line 7 "fuild" should read --fluid--.

Column 5 Line 52 Delete --a--.

Column 6 Line 7 "fuild" should read --fluid--.

Column 7 Line 17 "theform" should read --the form--.

Column 7 Line 31 "extertor" should read --exterior--.

Column 7 Line 31 Delete "," and insert --.--.

Column 7 Line 40 "commnunicate" should read --communicate--.

Column 7 Line 40 "wiih" should read --with--.

Column 8 Line 23 "chamaber" should read --chamber--.

Column 8 Line 24 "the" (second occurrence) should read --The--.

UNITED STATES PATENT AND TRADEMARK OFFICE

CERTIFICATE OF CORRECTION

PATENT NO. : 4,478,412

DATED : October 23, 1984

INVENTOR(S) : Arthur M. Muir

It is certified that error appears in the above-identified patent and that said Letters Patent is hereby corrected as shown below:

Claim 1 - Column 9 Line 7 After "said" insert --spaced--.

Claim 5 - Column 9 Line 59 "claim 3" should read --claim 1--.

Claim 5 - Column 9 Line 61 "righi" should read --right--.

Claim 6 - Column 9 Line 64 "claim 3" should read --claim 1--.

Claim 7 - Column 10 Line 3 "excercising" should read --exercising--.

Claim 7 - Column 10 Line 3 "claim 3" should read --claim 1--.

Claim 10 - Column 10 Line 25 "communicatton" should read --communication--.

Signed and Sealed this

*Twenty-third* Day of *July 1985*

[SEAL]

*Attest:*

DONALD J. QUIGG

*Attesting Officer*

*Acting Commissioner of Patents and Trademarks*